United States Patent [19]

Maddux, Jr. et al.

[11] Patent Number: 4,694,638

[45] Date of Patent: Sep. 22, 1987

[54] APPARATUS AND METHOD OF LOADING ARTICLES INTO AN INFLATED BAG FROM A WEB

[75] Inventors: Forrest E. Maddux, Jr.; Paul A. Eagle, both of Cincinnati; Robert L. Robbins, Covington, all of Ohio

[73] Assignee: The Ultra Bagger Co. of Cincinnati, Cincinnati, Ohio

[21] Appl. No.: 900,993

[22] Filed: Aug. 28, 1986

[51] Int. Cl.[4] ..... B65B 43/26

[52] U.S. Cl. ..... 53/459; 53/51; 53/64; 53/385; 53/469; 53/570; 53/468; 225/100; 225/106; 226/27

[58] Field of Search ..... 53/51, 66, 385, 389, 53/459, 468, 469, 564, 570, 247, 64; 225/100, 101, 106; 226/27, 33, 37

[56] References Cited

U.S. PATENT DOCUMENTS

| | | | |
|---|---|---|---|
| 3,477,196 | 11/1969 | Lerner | 53/570 |
| 3,579,948 | 5/1971 | Lerner | 53/385 |
| 3,754,370 | 8/1973 | Hanson | 53/385 |
| 3,881,410 | 5/1975 | Shenoha | 53/385 |
| 3,938,299 | 2/1976 | Lerner | 53/385 |
| 4,047,359 | 9/1977 | Gronebaum | 53/389 |
| 4,336,681 | 6/1982 | Onishi | 53/385 |
| 4,586,318 | 5/1986 | Litt et al. | 53/570 |

*Primary Examiner*—Robert L. Spruill
*Assistant Examiner*—Donald R. Studebaker
*Attorney, Agent, or Firm*—Frost & Jacobs

[57] ABSTRACT

The present invention provides an apparatus and method for loading articles into bags formed from a known roll of web material delineated by perforations at desired intervals. The web includes a first and second sheet of material. A sensor detects a perforation line and activates a sheet separator which opens or tears only the first sheet along a perforation line. The second sheet remains intact and preserves the web. A stream of air is directed at the open edge to inflate a bag. The bag is stabilized on a platform while articles are inserted. After articles are loaded, the second sheet is separated so that the bag is removed from the web and can be closed as desired.

13 Claims, 4 Drawing Figures

APPARATUS AND METHOD OF LOADING ARTICLES INTO AN INFLATED BAG FROM A WEB

BACKGROUND OF THE INVENTION

The present invention relates generally to an apparatus for loading articles into an inflated bag formed from a web. In particular, the present invention relates to an apparatus for separating sheets of a perforated web and directing a stream of air at the separated sheets to form a bag.

Plastic bags formed from a continuous sheet have been known in the art for some time. A sheet is perforated to form openings and provide separation of bags from the sheet. An opposite end of the bag is sealed, generally by thermal applications, to form an enclosed area. Conveyors and other apparatus are well known for handling and utilizing plastic bags from rolls. Certain devices have been developed for packaging a product in a plastic bag wherein fingers are used for various purposes. Examples of such devices include the following U.S. Pat. Nos.: 4,202,153; 4,344,269; 3,881,296; and 3,879,918.

Various sensor optics have been employed for guiding and positioning an article in a bag, examples of which can be found in the following U.S. Pat. Nos.: RE-28,350; 4,418,854; and 3,490,195.

A stream of air is often used to inflate a plastic bag formed from a roll. Examples of such devices include the following U.S. Pat. Nos.: 3,254,468; 3,298,156; 3,619,969; 3,682,051; 3,688,463; 3,754,370; 3,793,797; 3,842,569; 3,938,299; 3,948,015; 3,959,866; and 4,237,676.

One problem in forming a bag from a roll concerns separation of the web along perforations. It is desirable to open a bag without removing it from the web. When the web remains intact, conveyor technology can be employed to handle and load the roll of bags.

Another problem in the prior art involves stabilization of a bag after inflation. If a bag is not stabilized, loading of articles is more difficult and time consuming. Also, the bag may rip away from the web. One method shown by the prior art of stabilizing a bag involves a vacuum to hold a bag on the conveyor. However, such a vacuum can be expensive and require frequent maintenance.

Consequently, a need arises for improvements in conveyors for loading articles into bags formed from a roll. Such conveyors should include a device for opening a perforation line without separating a bag from the roll. In addition, such conveyors should provide an economical and low-maintenance method of stabilizing an inflated bag on the conveyor.

SUMMARY OF THE INVENTION

The present invention provides an apparatus and method for loading articles into bags formed from a known roll of web material delineated by perforations at desired intervals. The web includes a first and second sheet of material. A sensor detects a perforation line and activates a sheet separator which opens or tears only the first sheet along a perforation line. The second sheet remains intact and preserves the web. A stream of air is directed at the open edge to inflate a bag. The bag is stabilized on a platform while articles are inserted. After articles are loaded, the second sheet is separated so that the bag is removed from the web and can be closed as desired.

The present invention is an apparatus and method of loading articles into a bag formed from a known roll of web material. The web material is delineated by perforations and includes a first and second sheet. A web supply station supports the roll and includes a sensor for detecting perforations as the web is unwound. A sheet separating assembly actuated by the sensor, receives the web and separates only the first sheet along a perforation. A blower directs a stream of air at the open edge of the web to inflate a bag. A frame stabilizes the inflated bag to permit loading of desired articles into the bag.

DETAILED DESCRIPTION OF A PREFERRED EMBODIMENT

Figure 1:
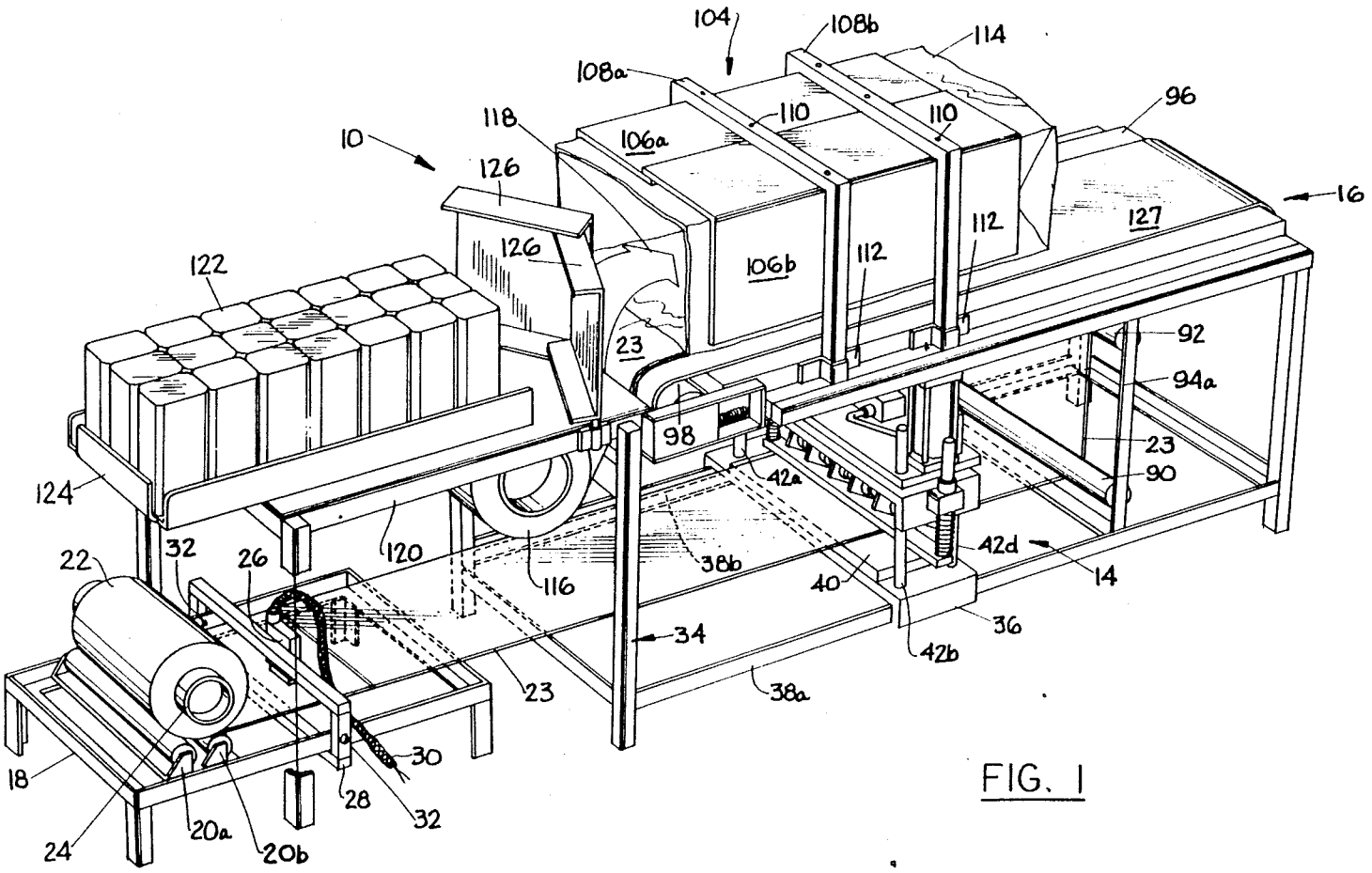
FIG. 1 is perspective view of an embodiment of the apparatus of the present invention.
Figures 2, 3:
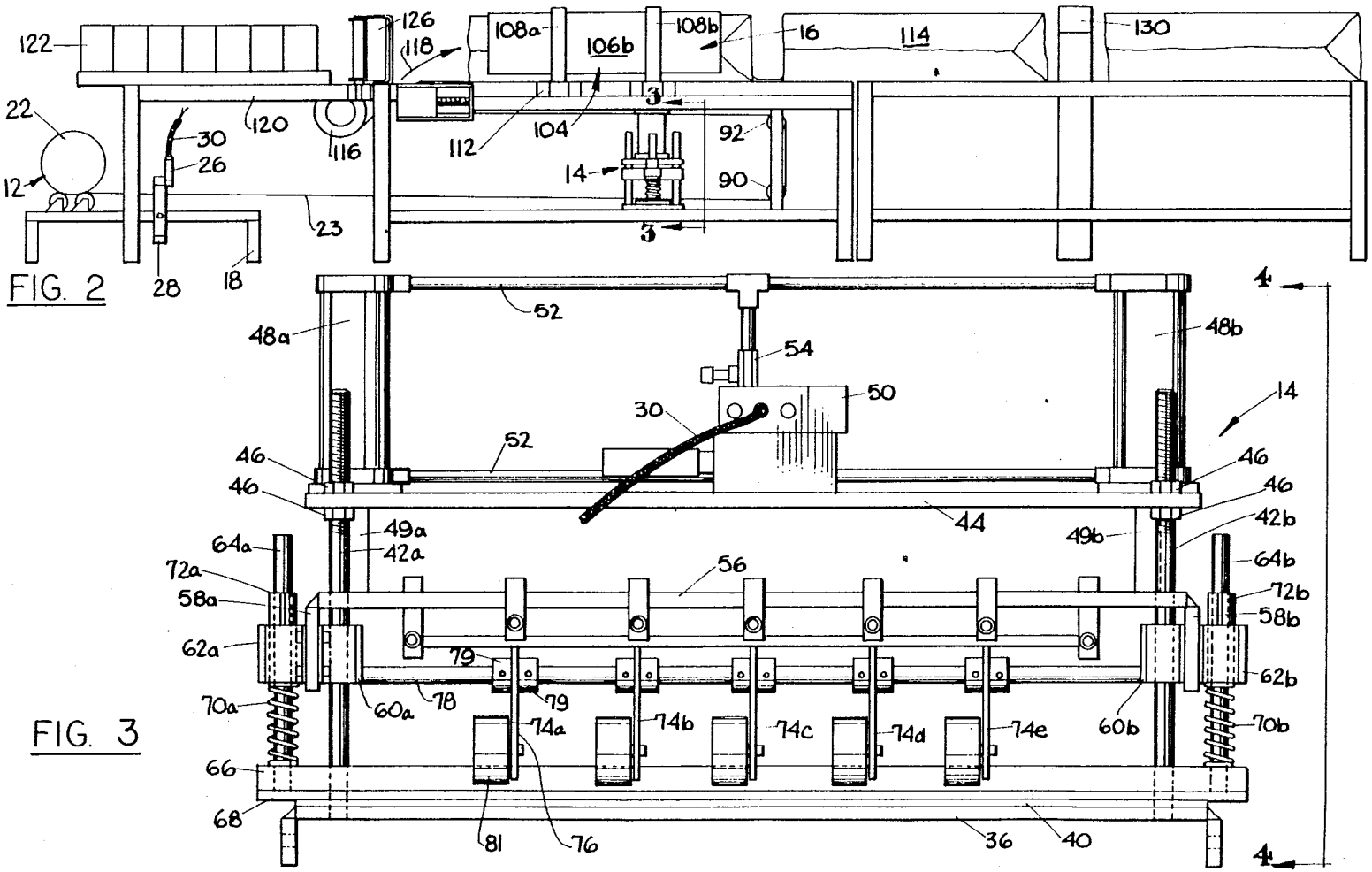
FIG. 2 is a side elevational view of the apparatus of FIG. 1.
FIG. 3 is a view taken along line 3—3 of FIG. 2.

A preferred embodiment of the apparatus of the present invention is generally indicated at 10 in FIGS. 1 and 2. The apparatus 10 includes a web supply station 12, a sheet separating assembly 14 and a conveyor assembly 16.

The web supply station 12 includes a sled 18 having a pair of horizontally mounted support rollers 20A and 20B. A roll 22 of plastic film material is placed on the support rollers 20A and 20B. The roll 22 includes a continuous web 23 of bags delineated by perforations at desired intervals wrapped about a spindle on mandrel 24. Formation of a roll 22 is well known. The web 23 includes a pair of sheets (not illustrated) which, for purposes of this description, will be referred to as an upper sheet and a lower sheet. The support rollers 20A and 20B are adjustable by known fasteners (not shown) along the length of the sled 18 to accommodate the size of the roll 22.

A sensor 26 is mounted on a bracket 28 which is in turn mounted on the sled 18. The sensor 26, preferably optic or photoelectric, detects perforations as the web 23 is unwound. The sensor 26 is commercially available and well known to those of ordinary skill in the art. A signal, generated by the sensor 26, is transmitted through a cable 30 to the sheet separating assembly 14 for advancing the web 23 in the manner described below. The bracket 28 is adjustable by fasteners 32 along the length of the sled to position the sensor 26 at a desired location. It is preferred that the sled 18 is not connected to the conveyor assembly so that the position of the roll 22 can be adjusted as desired and described below.

Figure 4:
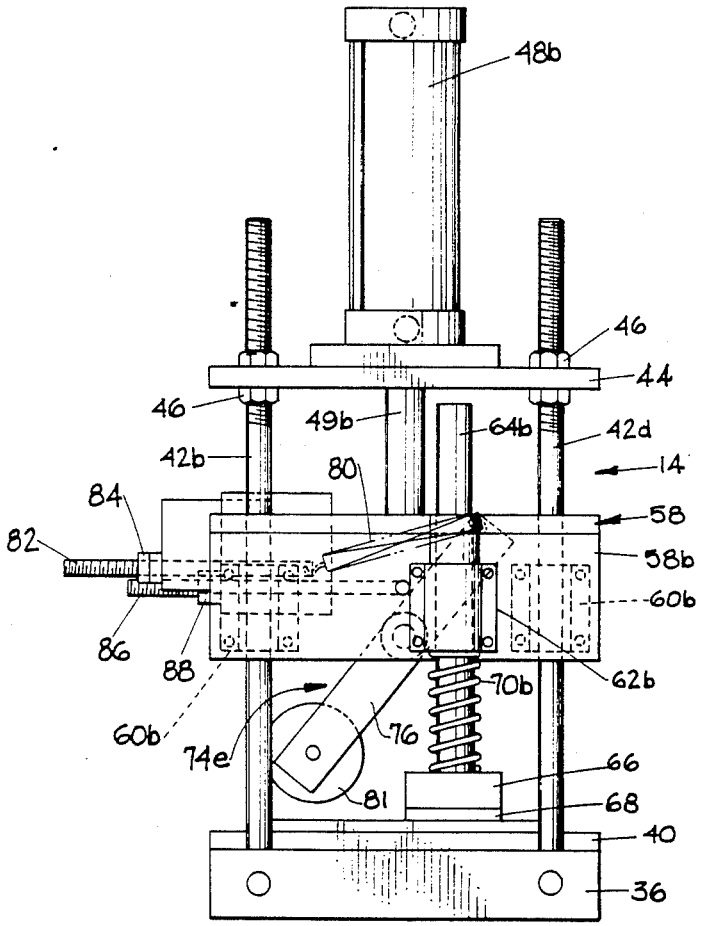
FIG. 4 is a view taken along line 4—4 of FIG. 3.

The sheet separating assembly 14, illustrated best in FIGS. 3 and 4, is mounted on a stand indicated generally at 34 which supports the conveyor assembly 16. A base plate 36 is mounted and straddled between two lower side bars 38A and 38B of the stand 34. A contact plate 40 is mounted on the upper surface of the base plate 36. Four support rods 42A–42D (42C is not shown in the Figures) having threaded upper portions are mounted to and project substantially perpendicularly to the base plate 36. An upper plate 44 is mounted on the support rods 42A–42D and located at a desired position by threading nuts 46. Two cylinders 48A and 48B, having push rods 49A and 49B, respectively, are mounted on the upper surface of the upper plate 44. A conventional controller 50 is mounted on the upper plate 44 for actuating the cylinders 48A and 48B. The controller 50 and cylinders 48A and 48B may be of any suitable system, such as electrical, hydraulic or pneumatic. A pneumatic system is depicted in the Figures with tubing 52 and a valve 54 connecting the controller 50 with the cylinders 48A and 48B.

The push rods 49A and 49B rest against a support plate 56 located between the contact plate 40 and the upper plate 44. As illustrated in FIG. 3, a flange 58A is provided on the left end of the support plate, and a corresponding flange 58B is provided on the right end of the support plate 56. Inner guide brackets 60A and 60B are mounted on the flanges 58A and 58B and include openings for receiving a corresponding support rod 42A–42D. Outer guide brackets 62A and 62B are mounted to the flanges 58A and 58B opposite the inner guide brackets 60A and 60B. The outer guide brackets 62A and 62B include openings for receiving a corresponding guide rod 64A and 64B. Each guide rod 64A and 64B is connected at its lower end to a bar 66 which is located above the contact plate 40. A guard 68, preferably constructed from silicon rubber, is mounted on the bar 66. Helical springs 70A and 70B are mounted on the guide rods 64A and 64B, respectively, between the bar 66 and outer guide brackets 62A and 62B. Fasteners 72A and 72B are mounted on respective guide rods 64A and 64B above the outer guide brackets 62A and 62B to secure the guide rods 64A and 64B at a desired position.

In FIG. 3, five finger assemblies 74A–74E are shown connected to the support plate 56. Each finger assembly 74A–74E includes a pivot lever 76 mounted on a rod 78 by brackets 79. The rod 78 is mounted between flanges 58A and 58B of the support plate 56. At an upper end, each lever 76 is connected to a retaining spring 80 (illustrated only in FIG. 4). The opposite end of each spring 80 is connected to a first threaded adjustment rod 82. The adjustment rod 82 is mounted to the support plate 56 and permits adjustment in the tension of spring 80 by turning adjustment nut 84. A second threaded adjustment rod 86 is mounted to the support plate 56 and permits adjustment of the range of motion of lever 76 by adjustment nut 88.

A non-rotatable roller member 81 is connected to the lower end of each lever 76. It is preferred that the roller be constructed from rubber or other similar material capable of frictionally gripping the web 23.

First and second reversing rollers 90 and 92 are mounted between vertical bars 94A and 94B (not shown) of the stand 34. The stand 34 further includes a horizontal platform 96 having rollers 98 and 100 (not shown) for rotating a belt 102. The rollers are driven by any desired drive means (not shown), such as a pneumatic, hydraulic or electrical drive, which can be mounted below the platform 96.

Above the platform 96, a bag frame indicated generally at 104 is provided. The frame 104 inclues a pair of L-shaped panels 106A and 106B. The panels 106A and 106B are supported by a pair of frames 108A and 108B with fasteners 110. The frames 108A and 108B are secured to the platform by brackets 112. Longitudinal slots (not shown) in the panels 106A and 106B permit adjustment of the panels 106A and 106B to accommodate various sizes of bags. It is preferred that the cover panels 106A and 106B be of sufficient width and length to substantially enclose an inflated bag 114, as illustrated in FIG. 1.

A conventional blower 116 is provided near roller 98. Air from the blower 116 is directed from a nozzle (not shown) to create an air stream illustrated by arrow 118. The blower 116 is mounted beneath a loading station 120. The loading station 120 can be formed with the stand or can be integral with an existing conveyor line. Articles 122 are received on the loading station and can be contained in a tray 124. If desired, guide arms 126 are mounted to the loading station 120. The guide arms 126 pivot toward the bag frame 104 to permit articles 122 to pass onto the conveyor belt 127 as described below.

In operation, a leading edge of the web 23 is fed from the roll 22 and routed through the sheet separating assembly 14. The web 23 passes between the contact plate 40 and the guard 68 of the bar 66. The web 23 is then routed over the first and second reversing rollers 90 and 92 and guided toward the blower 116 beneath the platform 96 of the conveyor assembly 16. The web 23 is passed over the conveyor rollers 90 and 92 and placed in contact with the belt 127. As the drive system is actuated, the web 23 unwinds from the roll 22 and provides a continuous source of bags for receiving articles 122.

As the web 23 unwinds from the roll 22, the sensor 26 detects perforations. A signal is transmitted through cable 30 to controller 50 to actuate the sheet separating assembly 14. The controller 50 activates the push rods 49A and 49B of cylinders 48A and 48B, respectively. The push rods 49A and 49B extend and force the supporting plate 56 and finger assemblies 74A–74E toward the contact plate 40. The roller members 81 are forced into contact with the web 23, and in particular, into contact with the upper sheet of the web 23. As contact is made, the roller members 81 frictionally grip the upper sheet. Each lever 76 pivots about rod 78 so that the roller member 81 has a small amount of translational movement along the direction of travel of the web indicated by arrow 134 in the Figures. This action causes the upper sheet to be torn or opened along a perforation, and does not disturb the perforation of the lower sheet.

The web 23 now having the upper sheet opened, passes over roller 98. At this point, the air stream 118 created by blower 116 inflates the bag 114, as illustrated in FIG. 1. The cover panels 106A and 106B enclose and stabilize the bag 114 on the belt 127. The perforation at the bottom sheet remains in contact. Once the bag 114 is inflated, articles are moved from the loading station 120 to the inflated bag 114. The loaded bag 114 is then moved along the platform by the belt. At this point, the bottom sheet of the web 23 can be separated along a perforation and the bag 114 can be closed to protect is contents.

If desired, separation of bags and sealing may be performed by a conventional bag sealer 130, as illustrated in FIG. 2. Generally, the sealer 130 includes a pair of jaws (not illustrated) which clamp together to separate the lower sheet from the web 23 and thermally seal the bag opening.

Adjustments for the friction force applied by the finger assemblies 74A–74E can be made to accommodate various types of web material. Adjustment rods 82 and 86 (illustrated only in FIG. 4) are used to adjust the tension in spring 80 and limit the range of motion of lever 76, respectively.

The web supply station 12 can be adjusted to accommodate rolls 22 of various sizes. The sled 18 and support rollers 20A and 20B can be positioned as needed to align and synchronize the sensor 26 so that the sheet separating assembly 14 tears or opens the perforations of the upper sheet of the web 23.

Although the present invention has been described with reference to preferred embodiments, workers skilled in the art will recognize that changes may be made in form and detail without departing from the spirit and scope of the invention.

What we claim is:

1. An apparatus for loading articles into an inflated bag from a web having at least two perforated sheets comprising:

(a) web supply means for receiving the web, the web supply means having sensor means for detecting perforations in the web;

(b) sheet separating means for separating an upper sheet of the web along a perforation, the sheet separating means being actuated by the sensor means, the sheet separating means comprising:

(i) a plurality of finger assemblies pivotally mounted on a support plate and biased away from the web;

(ii) cylinder means connected to the support plate for forcing the support plate in the direction of the web; and (iii) control means connected to the sensor for actuating the cylinder means so that the finger assemblies contact the web at desired intervals to separate the first sheet along a perforation; and (c) conveyor means for driving the web along its feed path, the conveyor means comprising a blower means for inflating a bag on the web after its first sheet has been separated by the sheet separating means and enclosure means for stabilizing the inflated bag on the conveyor means. assemblies contact the web at desired intervals to separate the first sheet along a perforation.

2. The apparatus as specified in claim 1 wherein each finger assembly comprises:

(a) a lever rotatably mounted on a rod, the rod being connected to the support plate;

(b) a retaining spring connected at its first end to an upper end of the lever and connected at its second end to the support plate;

(c) a non-rotatable roller member connected to the lower end of each lever for contacting the upper sheet of the web.

3. The apparatus as specified in claim 2 and further comprising:

(a) a first adjustment rod connected to the support plate for adjusting the tension in the retaining spring; and (b) a second adjustment rod connected to the support plate for adjusting the range of motion of the lever.

4. An apparatus for loading articles into an inflated bag from a web at least two perforated sheet comprising:

(a) web supply means for receiving the web, the web supply means having sensor means for detecting perforations in the web;

(b) sheet separating means for separating an upper sheet of the web along a perforation, the sheet separating means being actuated by the sensor means; and (c) conveyor means for driving the web along its feed path, the conveyor means comprising a blower means for inflating a bag on the web after its first sheet has been separated by the sheet separating means and enclosure means for stabilizing the inflated bag on the conveyor means, the enclosure means comprising:

(i) a plurality of frames connected to and suspended above the conveyor means; and (ii) panel means connected to the frame for forming an enclosure for stabilizing the inflated bag on the conveyor means.

5. A mechanism for separating perforations of a first perforated sheet of a web without separating perforations of at least a second perforated sheet of the web comprising:

(a) a plurality of finger assemblies pivotally mounted on a support plate and biased away from the web;

(b) cylinder means connected to the support plate for forcing the support plate in the direction of the web; and (c) means for detecting a perforation line and actuating the cylinder means so that the finger assemblies contact and separate the first sheet of the web along a perforation line.

6. The mechanism as specified in claim 5 wherein perforation lines are detected by an optical sensor.

7. The mechanism as specified in claim 6 wherein each finger assembly comprises:

(a) a lever rotatably mounted on a rod, the rod being connected to the support plate;

(b) a retaining spring connected at its first end to an upper end of the lever and connected at its second end to the support plate;

(c) a non-rotatable roller member connected to the lower end of each lever for contacting the upper sheet of the web.

8. The mechanism as specifieid in claim 7 wherein the roller member is constructed from a material which frictionally engages the first sheet.

9. The mechanism as specified in claim 8 and further comprising:

(a) a first adjustment rod connected to the support plate for adjusting the tension in the retaining spring; and (b) a second adjustment rod connected to the support plate for adjusting the range of motion of the lever.

10. A method for loading articles into a bag formed from a web delineated by perforations, the web having at least first and second perforated sheets, comprising:

(a) detecting perforations on the web by a sensor means;

(b) providing a sheet separating means comprising:

(i) a plurality of finger assemblies pivotally mounted on a support plate and biased away from the web;

(ii) cylinder means connected to the support plate for forcing the support plate in the direction of the web; and (iii) control means connected to the sensor for actuating the cylinder means so that the finger assemblies contact the web at desired intervals to separate the first sheet along a perforation;

(c) separating the first sheet along the perforation by actuating the cylinder means to force the plurality of finger assemblies against the web;

(d) advancing the web to a platform;

(e) blowing an air stream at the separating first sheet of the web so that a bag is inflated;

(f) stabilizing the inflated bag on the platform; and (g) advancing the articles into the inflated bag.

11. The method of claim 10 including the steps of:

(a) rotatably mounting a lever on a rod connected to the support plate;

(b) connecting a retaining spring at its first end to an upper end of the lever and at its second end to the support plate; and (c) connecting a non-rotatable roller member to the lower end of each lever for contacting the upper sheet of the web.

12. The method of claim 11 including the steps of:

(a) connecting a first adjustment rod to the support plate for adjusting the tension in the retaining spring; and (b) connecting a second adjustment rod to the support plate for adjusting the range of motion of the lever.

13. The method of claim 10 including the steps of (a) suspending a plurality of frames above the conveyor means; and (b) connecting at least a pair of panels to the frames for forming an enclosure to stabilize the inflated bag on the conveyor means.

* * * * *